US008682232B2

(12) United States Patent
Ito

(10) Patent No.: US 8,682,232 B2
(45) Date of Patent: Mar. 25, 2014

(54) IMAGE FORMING DEVICE

(75) Inventor: Michiaki Ito, Tokyo (JP)

(73) Assignee: Oki Data Corporation, Tokyo (JP)

( * ) Notice: Subject to any disclaimer, the term of this patent is extended or adjusted under 35 U.S.C. 154(b) by 133 days.

(21) Appl. No.: 12/766,302

(22) Filed: Apr. 23, 2010

(65) Prior Publication Data

US 2010/0284718 A1 Nov. 11, 2010

(30) Foreign Application Priority Data

May 8, 2009 (JP) ..... 2009-113393

(51) Int. Cl.
*G03G 15/20* (2006.01)

(52) U.S. Cl.
USPC ..... 399/308; 399/162; 399/350

(58) Field of Classification Search
USPC ..... 399/101, 123, 162, 302, 303, 308, 313, 399/343, 350
See application file for complete search history.

(56) References Cited

U.S. PATENT DOCUMENTS 5,915,156 A * 6/1999 Kizaki et al. ..... 399/346
6,072,976 A * 6/2000 Kuriyama et al. ..... 399/302
7,392,003 B2 6/2008 Ito
8,478,149 B2 * 7/2013 Takazawa ..... 399/49
2001/0006755 A1 * 7/2001 Itami et al. ..... 430/59.5
2002/0039506 A1 * 4/2002 Suzuki ..... 399/350
2003/0202819 A1 * 10/2003 Matsuda et al. ..... 399/121
2004/0114951 A1 * 6/2004 Kawagoe ..... 399/66
2005/0214045 A1 * 9/2005 Ohta et al. ..... 399/350
2005/0249529 A1 * 11/2005 Natori et al. ..... 399/302
2007/0201911 A1 * 8/2007 Ito ..... 399/299
2013/0164050 A1 * 6/2013 Ito ..... 399/302

FOREIGN PATENT DOCUMENTS

JP 2000010418 A * 1/2000 ..... G03G 15/16
JP A-2009-008904 1/2009

OTHER PUBLICATIONS

Victor Weidner and Jack Hsia, "NBS Measurement Services: Spectral Reflectance", Jul. 1987, National Bureau of Standards.*

* cited by examiner

*Primary Examiner* — Benjamin Schmitt
(74) *Attorney, Agent, or Firm* — Muncy, Geissler, Olds & Lowe, P.C.

(57) ABSTRACT

An image forming device having a cleaning device that removes an adhered object on an endless belt body by contacting the endless belt body, which rotates while under tension. The endless belt body is formed with the following includes: an indentation Young's modulus is equal to or more than 5.5 GPa and is equal to or less than 10.0 GPa, and a specularity of a contacting surface that contacts the cleaning device is equal to or more than 50 and is equal to or less than 100.

19 Claims, 4 Drawing Sheets

IMAGE FORMING DEVICE

CROSS REFERENCE

The present application is related to, claims priority from and incorporates by reference Japanese patent application number 2009-113393, filed on May 8, 2009.

TECHNICAL FIELD

The present invention relates to an image forming device and, especially, relates to an image forming device that has an endless belt body.

BACKGROUND

In a conventional image forming device, a cleaning blade contacts the surface of an endless belt body for purpose of removing toner adhered on the endless belt body. The toner that is scraped and removed by the cleaning blade is stacked on a toner stacking member. Then, the toner is supplied to a contacting part between the endless belt body and the cleaning blade as a lubricant agent. For example, see at paragraphs [0021]-[0032] and FIG. 2 of Japanese laid-open patent application publication number 2009-008904.

However, in the conventional technology discussed above, because the endless belt body is made of a soft resin as a primary layer, the specularity of the belt decreases due to surface abrasion by aging through printing so that the ability to maintain cleanliness of the belt deteriorates. Therefore, there is a problem that it is hard to reliably maintain cleanliness of the belt for a long period. Specularity refers to a property of a surface that has roughness and inclined angles. The specularity of a surface is the degree to which the surface is mirror-like. The specularity is obtained by a specific measuring equipment, such as Mirror SPOT AHS-100S of ARCHHARIMA Co. Ltd.

Considering the above drawbacks, an object of the present invention is to maintain the cleanliness of an endless belt for a long period.

SUMMARY

Accordingly, the present application discloses an image forming device having a cleaning device that removes an adhered object on an endless belt body by contacting the endless belt body, which rotates while under tension. The endless belt body is formed with the following includes: an indentation Young's modulus is equal to or more than 5.5 GPa and is equal to or less than 10.0 GPa, and a specutarity of a contacting surface that contacts the cleaning device is equal to or more than 50 and is equal to or less than 100.

Therefore, the present invention can have an effect in which the cleanliness of an endless belt is maintained for a long period.

DETAILED DESCRIPTION

An image forming device of an embodiment according to the present invention is explained below with reference to drawings.

First Embodiment

Figure 1:
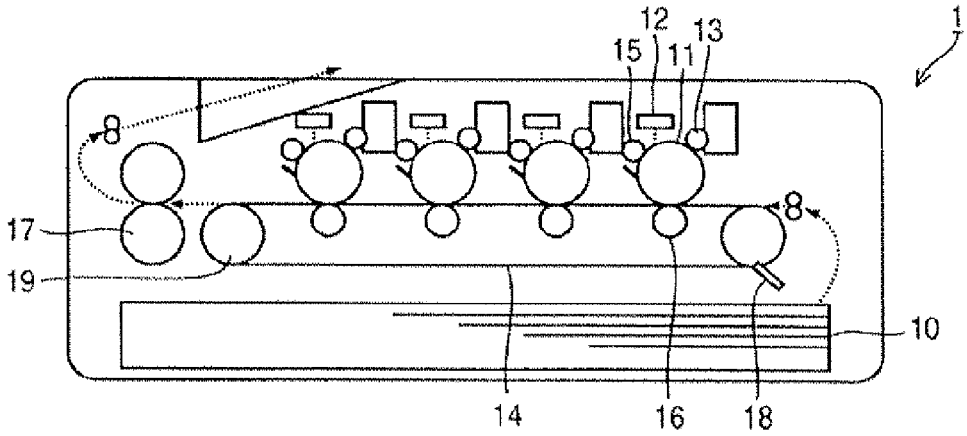
FIG. 1 is a schematic side view of an image forming device according to a first embodiment.

FIG. 1 is a schematic side view of an image forming device according to a first embodiment.

In FIG. 1, the image forming device 1 is configured with a photoreceptor drum 11 as an image carrier, a charge roll 15 that charges the surface of the photoreceptor drum 11, a light-emitting diode (LED) head 12 that forms an electrostatic latent image on the photoreceptor drum 11, a developing unit 13 that supplies toner as a developer to the electrostatic latent image on the photoreceptor drum 11 and develops the electrostatic latent image, a transferring roll 16 that transfers a developed toner image from the photoreceptor drum 11 to a recording material as a recording medium, an endless belt 14, a fusing unit 17 that fuses the transferred toner image on the recording material, a cleaning blade 18 as a cleaning means that removes remaining toner on the belt 14, and a sheet feeding unit 10 that feeds the contained recording material.

Figure 2:
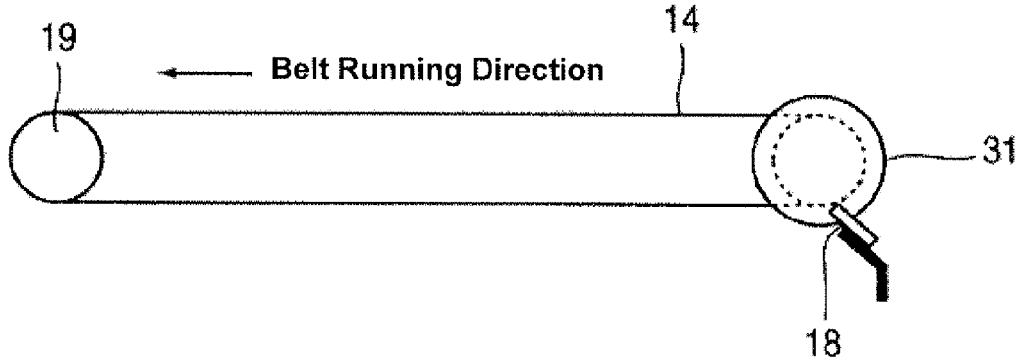
FIG. 2 is a schematic side view of an endless belt body driving device according to the first embodiment.

FIG. 2 is a schematic side view of an endless belt body driving device according to the first embodiment.

In FIG. 2, the belt 14 as an endless belt body is tensioned with tensioning force of 6(±10%) kg by a tensioning means (not shown) and is rotated by a driving roll 19. A flange 31, which is a guide unit having a flange shape, is provided. The flange 31 contacts the side part of the belt 14, is driven to rotate with the belt 14, and prevents the belt 14 from moving laterally.

The flange 31 can be attached to another rotating member or can be attached to contact both side parts of the belt 14 as needed. The flange 31 can also be attached to a belt supporting unit (not shown).

The cleaning blade 18, which is for removing residual toner on the belt 14, contacts the belt 14.

Figure 3:
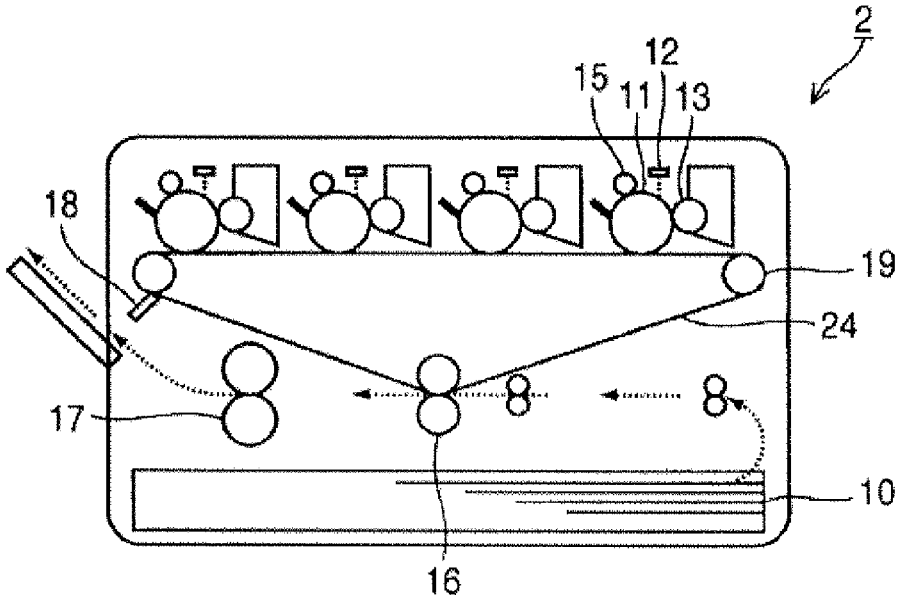
FIG. 3 is a schematic side view of an image forming device in an intermediate transferring system according to the first embodiment.
Figure 4:
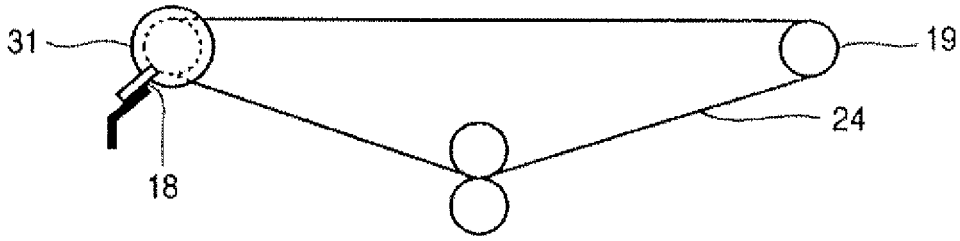
FIG. 4 is a schematic side view of an endless belt body driving device in an intermediate transferring system according to the first embodiment.

FIG. 3 is a schematic side view of an image forming device in an intermediate transferring system according to the first embodiment. FIG. 4 is a schematic side view of an endless belt body driving device in an intermediate transferring system according to the first embodiment. Structures that have the same structures of the image forming device and the endless belt driving device that are shown in FIGS. 1 and 2 have the same reference numerals as FIGS. 1 and 2 so that explanations of them are omitted.

In FIGS. 3 and 4, an endless belt 24 is an intermediate transferring body that directly carries a toner image that is developed. The belt 24 is tensioned with a tensioner (not shown) and is rotated by the driving roll 19. The flange 31 is provided to guide the belt 24. The flange 31 contacts the side part of the belt 24, is driven to rotate with the belt 24, and prevents the belt 24 from shifting laterally. As discussed above, the flange 31 can be attached to another rotating member or positioned to contact both side parts of the belt 24 as necessary. The flange 31 can also be attached to a belt supporting unit (not shown).

Next, the belt 14 as the endless belt body according to the present embodiment is explained in detail.

The belt 14 is formed through the following processes: properly adjusting various polyamide-imides as a material (PAI); blending the PAI with carbon black in an appropriate amount in order to have conducting properties; mixing and agitating it in N-methylpyrrolidone (NMP) solution; cast molding in a cylindrical mold; then, heating at 80-120° C. for a certain period of time while rotating; after that, continuing heating at increased temperature of 200-350° C. for a certain period of time; after that, demolding it; and obtaining a belt original tube in which a layer thickness is 100±10 μm, and in which the circumferential length is 624±1.5 mm. Following this processes, it is cut into a section in which the width is 228±0.5 mm.

The structure of the PAI is a polymer molecular form configured with continuous units. The units are composed of an amide group and one or two imide group(s) that are connected to the amide group through an organic group. The PIA is classified in an aliphatic PAI or aromatic PAI, respectively according to the type of the organic group (aliphatic or aromatic). In the present embodiment, the aromatic PAI is preferred in view of durability and mechanical properties. The aromatic, basically, represents that the organic group is one or two benzene ring(s), to which the imide group or amide group is connected.

The PAI can be in a complete imide ring closure phase or can be in a phase of amide acid in which an imide ring has not been completely closed. However, it is preferred that at least 50% or more of the PAI is imidized. More preferably, the PAI is one in which 70% or more of it is imidized is used. This is because the size change ratio tends to be large when there is too much PAI in a phase of amide acid.

The imidization ratio is calculated with a Fourier transform infrared spectrophotometer based on ratio of intensity between absorption derived from an imide group (1780 $cm^{-1}$) and absorption derived from a benzene ring (1510 $cm^{-1}$).

Generally, in order to increase the Young's modulus of the belt 14, there is a method of making the belt in a molecular configuration having many aromatic series rings and imide groups. In contrast, in order to decrease Young's modulus of the belt 14, there is a method of making the belt in a molecular configuration having less aromatic series rings and less imide groups.

The material for the belt 14 is not limited to the PAI that is used in the present embodiment. A material in which tension change is within a certain definite range at the time of belt driving is preferred in view of durability and mechanical properties. A material in which damage, such as abrasion of a side part and snapping and cracking of the side part, due to repeat sliding against lateral movement prevention guides, is less likely is preferred. For example, the following resin in which Young's modulus is equal to or more than 2.0 GPa, and preferably, is equal to or more than 3.0 GPa, like that of the PAI used in the present embodiment, and a mixture of the resin in which each of the following is a primary element may be used: polyimide (PI), polycarbonate (PC), polyamide (PA), polyether ether ketone (PEEK), polyvinylidene fluoride (PVdF), ethylene-tetrafluoroethylene copolymer (ETFE), and so on.

When the belt 14 is manufactured by rotation molding, a solvent is properly chosen based on the material to be used. An organic polar solvent is often used. Especially, N, N-dimethylacetamides is useful. Examples of the solvent are follows: N, N-dimethylformamide; N, N-dimethylacetamide; N, N-diethylformamide; N, N-diethylacetamide; dimethylsulfoxide; NMP mentioned above; pyridine; tetramethylenesulfone; and dimethyltetramethylenesulfone. A single one of these solvents may be used. Mixture of these solvents may also be used.

In view of accuracy of the thickness and thickness profiles of the belt, the rotating speed of the cylindrical mold at the time of the rotation molding is 5-1000 rpm and is preferably 10-500 rpm.

The above discussion is also applied to a method in which a belt is molded in a gap between two cylindrical molds that have a large and small diameter, respectively, and to the case in which the belt is molded on the outer circumferential surface of a cylindrical mold by deposition (application) or immersion.

On the other hand, a solution is not required for molding in the case of an extrusion molding and an inflation molding.

Examples of carbon black are follows: furnace black, channel black, kechen black, and acetylene black. A single one of these carbon blacks may be used. A mixture of these carbon blacks may also be used. A type of these carbon blacks can be properly selected based on desired conducting properties. Especially, channel black and furnace black are preferably used for the belt 14 of the image forming device according to the present embodiment. Depending on applications, it is preferred that the carbon black has a property that prevents oxidation degradation by oxidation treatment and graft treatment and has a property that improves dispersibility in a solvent.

The content of the carbon black is properly determined based on the type of the added carbon black according to its purpose. The belt used for the image forming device according the present embodiment has carbon black of 3-40% by weight, preferably 5-30% by weight, and more preferably 5-25% by weight out of the belt composition resin solid in view of required mechanical strength and so on.

Figure 9:
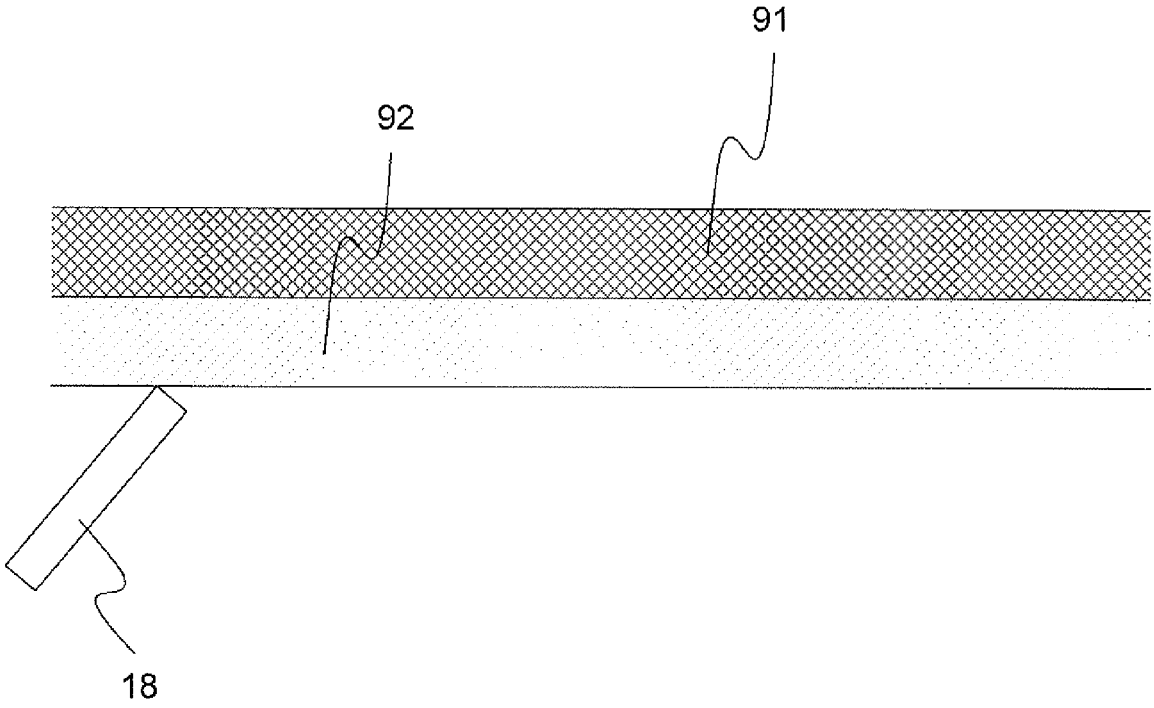
FIG. 9 is a sectional view of an endless belt body.

The specularity of the belt is obtained through properly adjusting the manner of polishing the inner circumference surface of the cylindrical mold. The sectional structure of the belt is shown in FIG. 9. The belt has two layers, a base layer 91 and a surface layer 92. The surface layer 92 is configured to cover the base layer 91 and to contact the cleaning blade 18 when the belt is equipped with the image forming device 1. For various purposes, other layers might be placed between the base layer 91 and the surface layer 92. Also, the base layer 91 might be coated on its both sides by the surface layer 92.

Toner is formed by an emulsion polymerization method in which paraffin wax of 9% by weight is contained inside of styrene-acrylic copolymer, which is a primary composition. Then, toner of which the average grain diameter is 7 μm, and of which sphericity is 0.95 is used. This toner is used because a high degree of sharpness and a high image quality are obtained through the following: improving the rate of transcription; lessening release agent for fusing; and developing with superior dot repeatability and superior resolution.

The cleaning blade 18 has the following properties: the material is urethane rubber; the rubber hardness is 72° (Japanese Industrial Standards: JIS A); the thickness is 1.5 mm; the linear pressure of the belt 14 is 4.3 g/mm; the shape is rectangular parallelepiped; and the rebound resilience is 34% (at temperature of 23° C.). A blade system for a cleaning part that is made of elastic material, such as urethane rubber, has a superior function for removing residual toner, foreign particles, and so on and has a simple and compact structure with a low cost. Urethane rubber is the most appropriate rubber material because it has high hardness, rich elasticity, superior abrasion resistance, mechanical strength, grease resistance, and ozone resistance or the like.

Generally, it is preferred that the urethane rubber that maintains cleanliness and that is used as the cleaning blade 18 according to the present embodiment has the following properties: the rubber hardness is 60°-90° (JIS A); the breaking elongation is 250-500%, and more preferably 300-400%; the permanent elongation is 1.0-5.0%, and more preferably, 1.0-2.0%; and the rebound resilience is 10-70%, and more preferably, 30-50%. Each of these physical properties can be measured by methods described in JIS K6301.

The linear pressure of the cleaning blade 18 with the belt 14 is 1-6 g/mm, and more preferably, 2-5 g/mm. When the linear pressure is too small, adhesiveness to the belt 14 is insufficient. Therefore, cleaning defects likely occur. On the other hand, when the linear pressure is too large, contact with the belt 14 becomes plane contact. Therefore, because friction resistance is excessively large, the pressing force is larger than the toner scraping force. As a result, cleaning defects, such as filming phenomena, and troubles, such as turning and everting, are likely occur.

The shaft diameter of the driving roll 19 according to the present embodiment for the belt is 25 mm (hereinafter, ϕ represents a diameter [mm]). However, this shaft diameter is not limited to this value. Because of cost and size reduction, the shaft that has a shaft diameter of (ϕ10-50 is generally used.

As a tensioner for the belt in the present embodiment, a spring is used so that the belt is tensioned with tensioning force of 6(±10%) kg. However, the method of tensioning the belt is not limited to a spring. The tension force for the belt is properly selected based on the material of the belt and the driving device for the belt. Generally, the belt is tensioned by the tension force of 2-8(±10%) kg.

In the present embodiment, the specularity of the belt is measured by a specularity measuring equipment (for example, MIRROR SPOT AHS-100S of ARCHHARIMA Co., Ltd.). The specularity is obtained by numerically converting image clarity of surface conditions. For example, the specularity is measured in U.S. Pat. No. 7,392,003. However, in the patent, the specularity is referred to as "shininess." U.S. Pat. No. 7,392,003 is incorporated herein by reference.

Shininess is a value calculated based on the clarity and brightness of a pattern reflected by an object when a reference pattern is projected onto the object. The shininess of an ideal object (a reference surface) has a value of shininess of 1000. The shininess of an object is expressed as a value relative to that of the ideal object. Values of shininess closer to the shininess of 1000 of the reference surface show that an object has a good value of (high) shininess.

A method for measuring shininess will be described below. This method employs a pattern projecting device, a photoelectric transducer, and a signal processing device.

The pattern projecting device includes a light source and a pattern projecting plate. The pattern projecting device is positioned such that the light from the pattern projecting plate is incident on the surface of an object at an angle θ. The angle θ may be selected at will depending on the type of an object and the method of measuring shininess. In the embodiment, the angle θ is selected to be 45°.

The photoelectric transducer is positioned such that the optical axis of the photoelectric transducer lies in a plane in which the optical axis of the light projected from the pattern projecting plate lies, and such that the optical axis of the photoelectric transducer forms an angle of 180-2θ with the optical axis of the light projected from the pattern projecting plate. The photoelectric transducer includes CCD arrays aligned in line or in a two-dimensional area, and captures a pattern projected onto the surface of the object. The captured pattern is converted into an electrical signal. The output of the photoelectric transducer is sent to the signal processing device.

The signal processing device includes a receiving section that receives the electrical signal from the photoelectric transducer, an A/D converter that converts the electrical signal into a digital signal, a data analyzer, and a display. The data analyzer processes the digital signal received from the A/D converter to extract local maxima (Max) and local minima (Min), and calculates the shininess of the object.

The data analyzer calculates an average Ave (Max) of local maxima Max(1), Max(2) . . . Max(n) and an average Ave (Min) of local minima Min(1), Min(2) . . . Min(n) from the following equations:

$$\mathrm{Ave(Max)} = \frac{\left\{\sum_{n=1}^{n=n} \mathrm{Max}(n)\right\}}{n} \tag{1}$$

$$\mathrm{Ave(Min)} = \frac{\left\{\sum_{n=1}^{n=n} \mathrm{Min}(n)\right\}}{n} \tag{2}$$

Based on the values of Ave(Max) and Ave(Min), the shininess may be calculated as follows:

$$\mathrm{Shininess}=[\{\mathrm{Ave(Max)}-\mathrm{Ave(Min)}\}/\{\mathrm{Ave(Max)}+\mathrm{Ave(Min)}\}]\times 1000 \tag{3}$$

As described above, the closer to the shininess of 1000 of a reference surface, the better the surface of an object.

In the present embodiment, an indentation (pressing) Young's modulus is measured by, for example, a Nano Indenter G200 of TOYO Corporation in conformity with ISO 14577. The Nano Indenter performs a loading-unloading test so that Young's modulus, hardness, and so on are measured in accordance with the loading and indentation displacement. In other words, elastic-plastic deformation is detected through indenting a sample by the indenter so that Young's modulus, hardness, and so on are measured with a high degree of accuracy. Because an indentation test with an ultra-low load can be performed, the micro surface condition and the layer structure of a sample can be measured by this equipment. The measurement method, requirements for the equipment, and correction of measurement are regulated by ISO 14577. This equipment is in conformity with ISO 14577.

In the present embodiment, the image forming device 1 shown in FIGS. 1 and 2 is used. However, the image forming device 1 is not limited to that shown in FIGS. 1 and 2. An image forming device 2 in an intermediate transferring system shown in FIGS. 3 and 4 may be used.

Operation of the structures discussed above is explained.

Performance of the image forming device 1 is explained with reference to FIG. 1.

After the image forming device 1 receives print data that instructs printing from a host device (not shown), the image forming device 1 feeds a recording material from a sheet feeding unit 10 and carries the recording material to the photoreceptor drum 11 by the belt 14.

After the surface of the photoreceptor drum 11 is charged by the charge roll 15, an electrostatic latent image is formed on the surface by the LED head 12. Because the electrostatic latent image is developed with toner that is supplied from the developing unit 13, the electrostatic latent image becomes a visible image.

A toner image as the visible image on the photoreceptor drum 11 is sequentially transferred to the recording material that is carried by the belt 14 that supports the recording material by the transferring roll 16.

The recording material in which the toner image is transferred is sent to the fusing unit 17. Then, the toner image is fused and is ejected.

After the recording material is separated, the belt 14 is cleaned by the cleaning blade 18 that removes remaining toner and foreign particles on the belt 14.

Next, operation of specularity measuring equipment, which measures the specularity of the surface of the belt 14 is explained.

The specularity, which is measured by the specularity measuring equipment according to the present embodiment, is calculated by the following method: clarity of a benchmark pattern (reflection image) appearing on the surface of an object to be measured is calculated with a relative value of a benchmark piece and a target object based on variability of brightness value distribution. A larger numerical number shows better condition of the surface profile through comparing with a specularity 1000 of the ideal surface as a benchmark.

Conventional quantitative measuring methods for the micro profile of the surface are roughness, glossiness, and so on. These methods measure only a part of the micro profile property. Measuring image clarity is generally evaluated visually. Therefore, it is hard to quantify micro profile of the surface.

Next, the Nano Indenter is explained.

An indentation Young's modulus of the belt 14 was measured by Berkovich (triangular pyramid) type diamond indenter and under the following conditions: the approach speed was 10 nm/sec; the maximum load was 10 mN; the time-to-maximum load was 10 seconds; the peak holding time was 3 seconds; and the drift rate was 1 nm/sec.

In the present embodiment, the reason that the indentation Young's modulus was adopted was that it was close to an actual parameter. When the belt surface was microscopically viewed, the surface was scratched by the drum, toner, the recording material, and other parts that contacted the belt. This was because pressure was applied in the thickness direction of the belt 14.

Conditions for cleaning evaluation of the belt are explained below.

Figure 5:
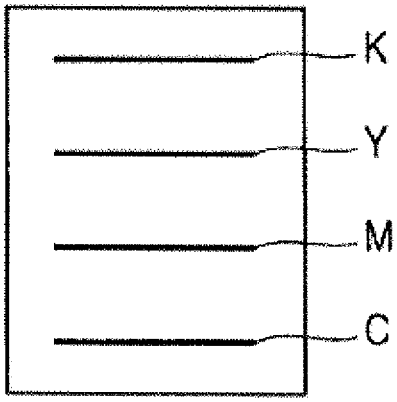
FIG. 5 is a schematic view of a printing pattern for cleaning evaluation according to the first embodiment.
Figure 6:
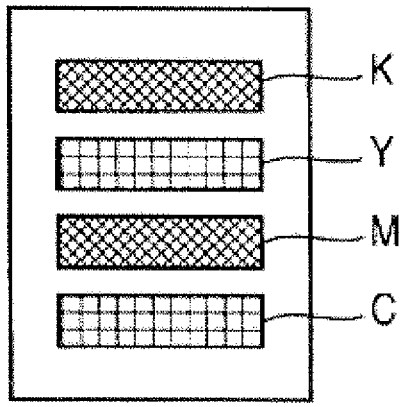
FIG. 6 is a schematic view of a printing pattern for cleaning evaluation according to the first embodiment.
Figure 7:
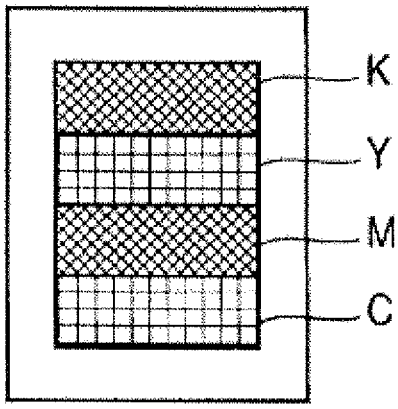
FIG. 7 is a schematic view of a printing pattern for cleaning evaluation according to the first embodiment.

The linear speed of the belt 14 was proximately 90 mm/sec. A sheet of A4 size as a recording material was used. As shown in FIGS. 5-7, printing patterns were transverse lines (a line that is in the orthogonal direction to the carrying direction) in each of colors, yellow, magenta, cyan, and black (YMCK). FIG. 5 shows a printing pattern on a sheet that is assumed to represent general text printing in which the concentration is 0.5% per recording material per color. FIG. 6 shows a printing pattern on a sheet that is assumed to represent a graph and photo printings in part in which the concentration is 7% per recording material per color. FIG. 7 shows a printing pattern on a sheet that is assumed to represent background printing of the entire sheet in which the concentration is 25% per recording material per color. Then, repeated printings of the above three sheets in which each sheet has one of three patterns were performed for 60,000 sheets, which is the lifespan of the belt.

Table 1 shows the results of the cleaning evaluation in which Young's modulus and specularity of the belt were varied. The cleaning evaluation is determined based on a degree of backside printing of a sheet. In the column of the cleaning evaluation in Table 1, the mark, "●," represents that cleaning defects did not occur. Similarly, the mark, "●," represents that very minor cleaning defects occurred. The mark, "Δ," represents that minor cleaning defects occurred, but there were not practical problems. The mark, "x," represents that cleaning defects occurred, and there were practical problems.

Figure 8:
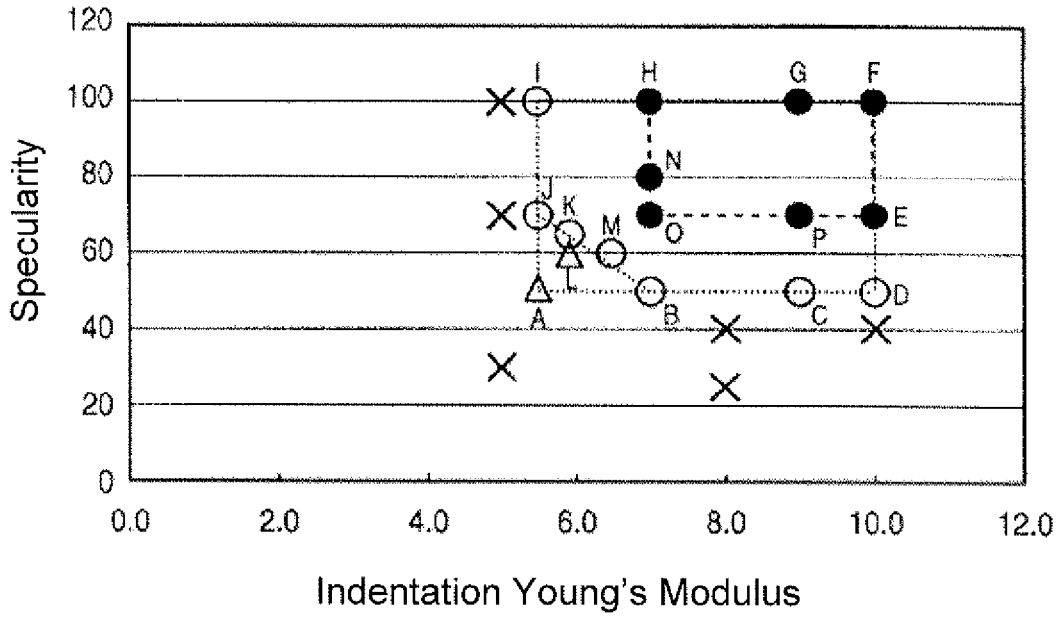
FIG. 8 is a graph of a cleaning evaluation result according to the first embodiment.

Data in Table 1 are graphically recorded in FIG. 8. The X-axis represents the indentation Young's modulus. The Y-axis represents the specularity. In FIG. 8, each of marks are the same as ones in Table 1, i.e., the mark, "●," represents that cleaning defects did not occur; the mark, "○," represents that very minor cleaning defects occurred; the mark, "Δ," represents that minor cleaning defects occurred, but there were not practical problems; and the mark, "x," represents that cleaning defects occurred, and there were practical problems.

TABLE 1

| No | PAI | Young's Modulus (GPa) | Specularity | Cleaning Evaluation (0.5%) | Cleaning Evaluation (7%) | Cleaning Evaluation (25%) |
|---|---|---|---|---|---|---|
| 1 | Aliphatic System | 5.0 | 30 | x | x | x |
| 2 | Aliphatic System | 5.0 | 70 | x | x | x |
| 3 | Aliphatic System | 5.0 | 100 | x | x | x |
| 4 | Aliphatic System | 5.5 | 50 | Δ | Δ | Δ |
| 5 | Aliphatic System | 5.5 | 70 | ○ | ○ | ○ |
| 6 | Aliphatic System | 5.5 | 100 | ○ | ○ | ○ |
| 7 | Aliphatic System | 6.0 | 60 | Δ | Δ | Δ |
| 8 | Aliphatic System | 6.0 | 65 | ○ | ○ | ○ |
| 9 | Aliphatic System | 6.5 | 60 | ○ | ○ | ○ |
| 10 | Aromatic System | 7.0 | 50 | ○ | ○ | ○ |
| 11 | Aromatic System | 7.0 | 70 | • | • | • |
| 12 | Aromatic System | 7.0 | 80 | • | • | • |
| 13 | Aromatic System | 7.0 | 100 | • | • | • |
| 14 | Aromatic System | 8.0 | 25 | x | x | x |
| 15 | Aromati System | 8.0 | 40 | x | x | x |
| 16 | Aromatic System | 9.0 | 50 | ○ | ○ | ○ |
| 17 | Aromatic System | 9.0 | 70 | • | • | • |
| 18 | Aromatic System | 9.0 | 100 | • | • | • |
| 19 | Aromatic System | 10.0 | 40 | x | x | x |
| 20 | Aromatic System | 10.0 | 50 | ○ | ○ | ○ |
| 21 | Aromatic System | 10.0 | 70 | • | • | • |
| 22 | Aromatic System | 10.0 | 100 | • | • | • |

Based on the results shown in Table 1 and FIG. 8, it is preferred for maintaining cleanliness that Young's modulus of the belt is 5.5-10 GPa, and the specularity is 50-100 (the area containing A, B, C, D, E, F, G, H, I, J, K, L, M, N, O, and P in FIG. 8). More preferably, Young's modulus and the specularities are in an area within the area described above that has larger values above the line connecting between a point of 5.5 GPa of Young's modulus and 70 of specularity and a point of 7.0 GPa of young's modulus and 50 of specularity (the area containing B, C, D, E, F, G, H, I, J, K, M, N, O, and P in FIG. 8). In other words, it is preferred that young's modulus of the belt is 5.5-10 GPa, the specularity is 50-100, and a value calculated by the next expression, "Indentation Young's modulus (GPa)×40+specularity×3," is equal to or over 430. Yet more preferably, young's modulus is 7.0-10.0 GPa and the specularity is 70-100 (the area containing E, F, G, H, N, O, and P in FIG. 8).

The reasons for that are explained below.

More unevenness of a belt surface increases the likelihood that contact substances will adhere on it and increases the likelihood of generating non-scraped remaining particles by a cleaning blade. This is explained by the following.

Generally, as printing is performed many times, particles and substances caused by toner, or a recording material, especially, paper are adhered and stacked on the belt. Once the particles and substances are adhered to the belt, the same particles and substances tend to gather on each other so that adhesion is easily accelerated. This is because intermolecular force is increased, and compatibility is improved.

Meanwhile, silica and calcium carbonate are the main adhering substances caused by toner or paper. Because these substances have very high hardness, they generate scratches on the belt as a contact member by abrasion and wear of the belt.

These phenomena tend to be developed when Young's modulus of the belt is lower than 5.5 GPa, and the specularity of the belt is lower than 50. The reasons for this are explained below.

First, when the specularity of the belt surface is lower than 50, it is hard for the cleaning blade to secure uniform linear pressure with respect to the belt. Toner adhered on the belt surface can easily escape from being scraped. The more the sphericity of toner is increased and the more the diameter of the toner is reduced, the more avoidance of scraping occurs.

And, the more the grain diameter of the toner is reduced, the higher the image quality, in general. Because the specific surface area is larger, the adhesion force per unit weight of toner to the belt is larger. Therefore, the cleanliness of the belt tends to decline.

Further, the more the grain diameter of the toner is reduced, the more the flowability of the toner declines. Therefore, much additive agent made primarily of silica and wax is required. When the specularity is low, the additive agent easily remains on the belt surface so that the remaining additive agent escapes from being scraped. Because the additive agent escapes from being scraped, local shearing force is applied to the cleaning blade. As a result, a local edge crack (chipping) occurs in the cleaning blade, which may cause destruction of the cleaning blade.

Second, when Young's modulus of the belt is lower than 5.5 GPa, scratches can easily occur on the belt surface. The smaller the Young's modulus, the more easily scratching can occur by the silica and calcium carbonate discussed above with high hardness at every each printing. A lower Young's modulus encourages scratches. As a result, adhesiveness between the cleaning blade and the belt declines so that cleaning defects easily occur. This shows that it is not enough for only the specularity of the belt surface to be large. In other words, even though cleanliness is good at the beginning stage, scratches occur on the belt surface with respect to each printing after that. Therefore, the more the specularity is decreased, the more the cleaning capability is decreased.

Third, the more the Young's modulus of the belt is lower than 5.5 GPa, and the more the specularity is lower than 50, the more the belt surface becomes uneven. As a result, wax and foreign additive agent in the vicinity of the top surface of the printing surface of the recording material are easily scraped by a micro-slip existing between the belt and the printing surface of the recording material. This is the reason for adhesion to the belt surface. Many of these wax and foreign additive agents are retained at an edge part of the cleaning blade. As a result, these wax and foreign additive agents can escape from being scraped so that this is a factor that causes cleaning defects.

When residual material on the belt is increased, adhesiveness and affinity between the cleaning blade and the residual material on the belt is increased so that a phenomenon of increasing frictional force occurs. Shearing stress between the belt surface and the cleaning blade is increased due to an increase of the frictional force. As a result, fatal phenomena, such as a local edge cracks, and turning and everting of the cleaning blade may occur.

These phenomena become conspicuous when the printing concentration is larger.

In order to fix the cleaning defects, measures have been proposed as follows: the cleaning defects are decreased by increasing the linear pressure between the cleaning blade and the belt. However, the measures greatly increase the strain on the cleaning blade. As a result, phenomena such as destruction of an edge, and turning and everting of the cleaning blade easily occur. Increasing the linear pressure is not preferred because the occurrence of scratches on the belt surface is also accelerated.

On the other hand, it is preferred that the specularity of the belt surface is equal to or less than 100. When the specularity of the belt surface is more than 100, adhesiveness between the cleaning blade and the belt is increased so that frictional force is also greatly increased. As a result, the following occurs: the torque for driving the belt is increased; the power-supply device must be enlarged to support the increased torque; shearing stress between the belt surface and the cleaning blade is increased due to increasing of the frictional force; and then, fatal phenomena, such as a local edge cracks, and turning and everting of the cleaning blade easily occur.

It is preferred that Young's modulus of the belt is equal to or less than 10.0 GPa. It is technically very hard to manufacture a belt in which Young's modulus is more than 10.0 GPa. When an attempt is made to manufacture such a belt, there are difficulties in its manufacturing, and much equipment and time are required. As a result, the yield ratio is decreased, and cost is increased. Therefore, it is virtually impossible to use such a belt for an image forming device according to the present embodiment.

In the present embodiment, an image forming device is explained as the image forming device 1 in FIG. 1. However, the present embodiment is not limited to the image forming device 1. The image forming device 2 that uses an intermediate transferring system as shown in FIG. 3 in which an endless belt 24 directly carries a toner image that is visible through development may be used as an image forming device according to the present embodiment.

As explained above, in the first embodiment, since Young' modulus of the belt is 5.5-10 GPa, and the specularity of the belt surface is 50-100, the following effects are obtained.

Decreasing of the specularity due to surface abrasion and adhesion of foreign particles, such as paper dust, by aging through printing is prevented so that good cleanliness can be maintained for a long period of time.

Second Embodiment

In a second embodiment, a belt 14 is formed by the following methods: a belt base member as a base layer is formed by properly adjusting the indentation Young's modulus to 3.0-10.0 GPa; and a surface layer made of a hard coat member, of which the indentation Young's modulus 7.0-10.0 GPa, is formed on the belt base member. Other structures in the second embodiment are the same as that of the first embodiment. Therefore, their explanation is omitted by assigning same reference numerals.

The belt base member (base layer) is produced by using a resin, such as polyamide (PA), polybutylene terephthalate (PBT), polycarbonate (PC), and polyvinylidene fluoride (PVdF), and with a layer thickness of 140±10 μm.

After an acrylic ultraviolet curing type hard coat member was properly diluted, agitated, and mixed with methyl isobutyl ketone (MIBK), it was deposited with a thin film on the belt base member by a roll coater. After that, ultraviolet was irradiated on the thin film for curing the thin film by UV radiation. As a result, a surface layer with a layer thickness of 0.8±0.2 μm was formed.

A function of the structures discussed above is explained. In the second embodiment, evaluation methods and conditions for cleaning performance, and determination methods for cleanliness are the same as that of the first embodiment. However, in the second embodiment, a printing pattern with transverse lines (a line that is in the orthogonal direction to the carrying direction) of each of colors, yellow, magenta, cyan, and black (YMCK) was used. The printing pattern on a sheet was assumed to represent general text printing in which the concentration is 0.5% per a recording material per color (see FIG. 5).

Table 2 shows the evaluation results of the belt 14.

The evaluations were performed with the following conditions. The surface layer material system was acrylic. The base layer material system was polyamide (PA), polybutylene terephthalate (PBT), polycarbonate (PC), or polyvinylidene fluoride (PVdF). The indentation Young's modulus of the surface layer was 7.0 GPa.

In the column of the cleaning evaluation in Table 2, the mark, "○," represents that very minor cleaning defects occurred. The mark, "x," represents that cleaning defects occurred, and there were practical problems.

TABLE 2

| No | Surface Layer Material System | Base Layer Material System | Young's Modulus of Surface Layer (GPa) | Young's Modulus of Base Layer (GPa) | Specularity of Surface Layer | Cleaning Evaluation (0.5%) |
|---|---|---|---|---|---|---|
| 23 | — | PA | — | 3.0 | 30 | x |
| 24 | Acrylic | PA | 7.0 | 3.0 | 60 | ○ |
| 25 | Acrylic | PBT | 7.0 | 3.0 | 60 | ○ |
| 26 | — | PC | — | 4.5 | 30 | x |
| 27 | Acrylic | PC | 7.0 | 4.5 | 65 | ○ |
| 28 | Acrylic | PVdF | 7.0 | 3.5 | 70 | ○ |

As shown in Table 2, when the surface layer has an indentatiion Young's modulus equal to or more than 7.0 GPa and equal to or less than 10.0 GPa, and the specularity is equal to or more than 50 and is equal to or less than 100, even though the belt base member has indentation Young's modulus of 3.0-10.0 GPa, a reduction of the specularity due to surface abrasion and adhesion of foreign particles, such as paper dust, by aging through printing is prevented so that good cleanliness can be maintained for a long period of time, as in the first embodiment.

Because the belt as a whole is elastically deformed while the cleaning performance is maintained, removal of toner from printed images, which is referred to as a part removal of characters and line images, can be prevented.

Further, because of the contribution of the elastic deformation, load variation at the time of belt driving is absorbed. As a result, there is an added effect that lateral movement of the belt is prevented.

The part removal occurs by the following processes: Pressure strength due to rolling at the time of transferring and fusing is concentrated at a toner layer; charge density is increased by aggregation of toner; then, discharge occurs inside the toner layer; then, toner polarity is changed; and finally, toner removal, or part removal, occurs. Generally, this phenomenon easily occurs when a belt with a higher Young's modulus is used. This is because elastic deformation amount with respect to the pressure strength is small.

As explained above, in the second embodiment, when the indentation Young's modulus is equal to or more than 7.0 GPa and is equal to or less than 10.0 GPa, and the specularity is equal to or more than 50 and is equal to or less than 100; the following effects are obtained: while maintaining good cleanliness, image defects, such as the part removal, are decreased; fatal problems due to breakage of the belt do not occur; and a belt has running stability for a long period of time.

In the first and second embodiments, the image forming device is explained as a printer in electrographic system. However, the present embodiments are not limited to this and may be applied to a multifunction machine, facsimile machine, and so on other than a printer.

The belt is explained as a transferring belt. However, the present embodiments are not limited to this and may be applied to endless belt bodies such as a photoreceptor belt, fusing belt, carrying belt, and so on.

The image forming device being thus described, it will be apparent that the same may be varied in many ways. Such variations are not to be regarded as a departure from the sprit and scope of the invention, and all such modifications as would be apparent to one of ordinary skill in the art are intended to be included within the scope of the following claims.

What is claimed is:

1. An image forming device having a cleaning device that removes an adhered object on an endless belt body by contacting the endless belt body, which rotates while under tension, wherein the endless belt body is formed with the following conditions:

an indentation Young's modulus is equal to or more than 5.5 GPa and is equal to or less than 10.0 GPa, and a specularity of a contacting surface that contacts the cleaning device is equal to or more than 50 and less than 100, wherein the specularity of the contacting surface is determined by calculating a clarity of a benchmark reflection image appearing on the surface of an object to be measured with a relative value of a benchmark piece and a target object based on variability of a brightness value distribution, and a measurement of specularity can range from 0 which indicates a low benchmark to 1,000 which indicates a high benchmark.

2. The image forming device according to claim 1, wherein the indentation Young's modulus (GPa)×40+the specularity×3 is equal to or greater than 430 in the endless belt body.

3. The image forming device according to claim 2, wherein the endless belt body is formed with the following conditions:

the indentation Young's modulus is equal to or more than 7.0 GPa.

4. The image forming device according to claim 1, wherein the endless belt body is configured with at least two layers that are a surface layer and a base layer, the surface layer contacting the cleaning device and the base layer being covered by the surface layer, and wherein the surface layer is formed with the following conditions:

the indentation Young's modulus is equal to or more than 7.0 GPa and is equal to or less than 10.0 GPa, and the specularity of the contacting surface is equal to or more than 50 and is equal to or less than 100.

5. The image forming device according to claim 1, wherein the cleaning device is a cleaning blade that scrapes the endless belt body, and the cleaning blade is made of rubber that has a hardness of 60°-90° (JIS A).

6. The image forming device according to claim 1, wherein the cleaning device is a cleaning blade that scrapes the endless belt body, and the cleaning blade is made of rubber and the breaking elongation of the rubber is 250-500%.

7. The image forming device according to claim 1, wherein the cleaning device is a cleaning blade that scrapes the endless belt body, and the cleaning blade is made of rubber and the permanent elongation of the rubber is 1.0-5.0%.

8. The image forming device according to claim 1, the cleaning device is a cleaning blade that scrapes the endless belt body, and wherein the cleaning blade is made of rubber and the rebound resilience of the rubber is 10-70%.

9. The image forming device according to claim 1, the cleaning device is a cleaning blade that scrapes the endless belt body, and wherein the cleaning blade is constructed and arranged to apply a linear pressure of 1-6 g/mm to the endless belt body.

10. The image forming device according to claim 1, wherein the specularity of the contacting surface that contacts the cleaning device includes a consideration of both glossiness and clarity of the contacting surface that contacts the cleaning device.

11. The image forming device according to claim 1, wherein the endless belt body comprises:

a surface layer having an indentation Young's modulus of between 7.0-10.0 GPa; and a base layer having an indentation Young's modulus of between 3.5-10.0 GPa.

12. The image forming device according to claim 1, wherein the endless belt body includes 3-40% by weight of carbon black with respect to the belt composition resin solid.

13. The image forming device according to claim 1, wherein the contacting surface of the endless belt body has a micro profile such that the specularity of the contacting surface is more than 50 and is equal to or less than 100.

14. The image forming device according to claim 1, wherein the endless belt is tensioned with between 1.8 and 8.8 kg of force.

15. The image forming device according to claim 1, wherein the specularity is calculated based on an intensity of dark and bright portions of a test pattern reflected from the contact surface, and using an equation:

$$S=((\mathrm{Ave(Max)}-\mathrm{Ave(Min)}))/((\mathrm{Ave(Max)}+\mathrm{Ave(Min)}))\times 1{,}000$$

where S is the specularity, Ave (Max) is an average of local maxima of the bright portions and Ave (Min) is an average of local minima of the dark portions.

16. An image forming device, comprising:

an endless belt, which rotates under tension; and a cleaning device that removes adhered matter from an outer surface of the endless belt by scraping the outer surface, wherein the endless belt is formed to have the following properties:

an indentation Young's modulus of the endless belt is equal to or more than 5.5 GPa and equal to or less than 10.0 GPa, and a specularity of the outer surface, which contacts the cleaning device, is equal to or more than 50 and is less than 100, wherein the specularity is calculated based on an intensity of dark and bright portions of a test pattern reflected from the contact surface using an equation:

$$S=((\mathrm{Ave(Max)}-\mathrm{Ave(Min)}))/((\mathrm{Ave(Max)}+\mathrm{Ave(Min)}))\times 1{,}000$$

where S is the specularity, Ave (Max) is an average of local maxima of the bright portions, and Ave (Min) is an average of local minima of the dark portions, thereby a measurement of specularity can range from 0 which indicates a low benchmark to 1,000 which indicates a high benchmark.

17. The image forming device according to claim 16, wherein the specularity of the outer surface includes a consideration of both glossiness and clarity of the outer surface.

18. The image forming device according to claim 16, wherein the cleaning blade is constructed and arranged to apply a linear pressure of 1-6 g/mm to the endless belt body.

19. The image forming device according to claim 16, wherein the indentation Young's modulus (GPa)×40+the specularity×3 is equal to or greater than 430 in the endless belt body.

* * * * *